US005407323A

United States Patent [19]

Gay et al.

[11] Patent Number: 5,407,323

[45] Date of Patent: Apr. 18, 1995

[54] FLUID PUMP WITH INTEGRAL FILAMENT-WOUND HOUSING

[75] Inventors: Farral D. Gay, Elkhorn; Steven D. Schneider, Delavan; William E. Howard, Waukesha, all of Wis.

[73] Assignee: Sta-Rite Industries, Inc., Delavan, Wis.

[21] Appl. No.: 239,447

[22] Filed: May 9, 1994

[51] Int. Cl.[6] ..... F01D 1/02

[52] U.S. Cl. ..... 415/200; 415/199.1

[58] Field of Search ..... 415/200, 182.1, 199.1

[56] References Cited

U.S. PATENT DOCUMENTS

| | | | |
|---|---|---|---|
| 702,590 | 6/1902 | Reynolds | 415/200 |
| 2,648,286 | 8/1953 | Bergh . | |
| 2,670,686 | 3/1954 | Bergh . | |
| 3,381,617 | 5/1968 | Wright | 415/200 |
| 3,826,589 | 7/1974 | Frank et al. | 415/170 A |
| 4,021,137 | 5/1977 | Zehren | 415/147 |
| 4,038,118 | 7/1977 | James | 156/143 |
| 4,172,690 | 10/1979 | Kuntz | 415/199.2 |
| 4,234,291 | 11/1980 | Hurst et al. | 415/200 |
| 4,406,582 | 9/1983 | LaGrange | 415/214 |
| 4,708,589 | 11/1987 | Nielsen et al. | 415/199.2 |
| 4,913,630 | 4/1990 | Cotherman | 417/313 |
| 4,923,367 | 5/1990 | Zimmer | 415/199.1 |
| 4,930,996 | 6/1990 | Jensen et al. | 417/373 |
| 4,981,420 | 1/1991 | Jensen et al. | 417/423.3 |
| 5,028,218 | 7/1991 | Jensen et al. | 417/423.3 |
| 5,046,922 | 9/1991 | Nakamura | 415/172.1 |
| 5,133,639 | 7/1992 | Gay et al. | 415/170.1 |
| 5,141,396 | 8/1992 | Schmidt et al. | 415/200 |
| 5,257,916 | 11/1993 | Tuckey | 417/423.3 |

FOREIGN PATENT DOCUMENTS

| | | | |
|---|---|---|---|
| 195985 | 8/1993 | Japan | 415/200 |

*Primary Examiner*—John T. Kwon

*Attorney, Agent, or Firm*—Jansson & Shupe, Ltd.

[57] ABSTRACT

A fluid pump has an integral filament-wound housing bonded to internal parts of the pump. The pump housing is made of composite material (such as fiberglass strands coated with epoxy resin) wound about an adapter, pumping members and an output flange. Once hardened, the housing, adapter, pumping members and output flange are permanently bonded together to form a unitary structure. Pump efficiency is greatly enhanced because the pump housing forms a fluid-tight seal between (a) pumping members and (b) between pumping members and the housing and further prevents rotation of the pumping members in response to torque forces during pump operation.

10 Claims, 4 Drawing Sheets

FLUID PUMP WITH INTEGRAL FILAMENT-WOUND HOUSING

FIELD OF THE INVENTION

This invention is related generally to fluid handling and, more particularly, to fluid pumps.

BACKGROUND OF THE INVENTION

Fluid pumps are well known, have been utilized in both commercial and residential applications and involve a wide variety of design types, e.g., positive displacement, venturi and the like. One design type, a cylindrically-shaped centrifugal pump sometimes referred to as a "flinger" pump, is widely used to pump water out of water wells. Examples of such fluid pumps are described in U.S. Pat. Nos. 4,708,589 (Nielsen et al.) and 4,923,367 (Zimmer).

Such pumps are preferred for water wells, e.g., residential wells, since they can be configured to have a relatively small diameter to readily fit into a well hole. Notwithstanding, multistage centrifugal pumps have substantial pumping capacity.

Each "stage" of such a pump has an impeller which "flings" water radially outward by centrifugal force. All impellers are driven by a common central shaft attached to a sealed electric motor. Each stage also includes a diffuser and a suction cap and such stages (perhaps seven in number) are "stacked" end-to-end so that the discharge portion of one stage feeds liquid into the inlet portion of the next stage.

When so stacked (and assuming the pump housing is not in place), the circular edges of the diffuser and the suction cap are visible. The impeller is confined within the stack and is not visible.

At one end of the stack is an adapter for receiving and mounting the electric motor. At the other end of the stack is an output flange from which water flows and to which is attached a pipe leading to the building for which water is being supplied.

For reasons relating to leakage prevention and pump efficiency, it is desirable to retain the pump stages and the adapter and output flange snugly compressed against one another. In one exemplary type of prior art pump as shown in the aforementioned Nielsen et al. patent, stage/adapter/flange compression is by a hollow, cylindrical metal housing sleeved over the stacked stages.

One way compression is maintained is by crimping the housing to the adapter and output flange. Another way is to form threads on the exteriors of the adapter and the output flange and on the interior of the housing at the housing ends. The adapter and the flange are then screwed to respective ends of the housing. The adapter and flange may be prevented from rotating by a set screw or other fastener.

In another type of pump as shown in the aforementioned Zimmer patent, the housing is embodied as a pair of plastic half-cylinders joined together by fasteners. Compression of the stages is provided by an adjustment cone rather than by the housing.

In yet another type of prior art pump, believed to be made by Morris Industries, it is understood that a composite housing made by winding filaments is substituted for the metal sleeve-like housing. That is, such composite housing (which is understood to be threaded at both ends or at least have threaded fasteners at such ends) is sleeved over the stacked stages and then screwed to the adapter and output flange.

While these prior art pumps have been generally satisfactory for their intended purpose, they tend to be characterized by certain disadvantages. For example, the compressive force holding the stages against each other can decrease over time. As a result, the stages (or parts of stages) may separate slightly and leaks develop. And in a more extreme case, the diffuser and/or the suction cap (both of which are subjected to torsional forces by the moving water in the pump) may rotate. This is so since in known pumps, the sole force preventing rotation is compression force and if such force diminishes sufficiently, rotation results. In other words, sleeved housings do not per se exert countertorque on the diffuser or suction cap. Either leakage or unwanted rotation of pump parts results in a decrease in pump performance.

And another disadvantage arises merely from the fact that many known pump housings are metal, i.e., stainless steel. Such housings are relatively thin walled and may dent if dropped. In a severe case, a diffuser or suction cap within the housing may be fractured.

And if ordinary steel is selected as a housing material or for other components, rust and corrosion are sure to occur soon after the onset of pump use. For example, a metal set screw securing the adapter and output flange to the housing can corrode and become displaced resulting in formation of an opening in the housing through which water can escape resulting in decreased performance. Further, for a housing of given dimensions including wall thickness, metal housings weigh more than those made with alternative materials such as plastic. Plastic and composites, are also typically less expensive than materials such as stainless steel.

OBJECTS OF THE INVENTION

It is an object of this invention to provide a fluid pump which overcomes some of the problems and shortcomings of devices of the prior art. Another object is to provide a pump with a fluid-tight seal between the pump member(s) and the pump housing.

A further object of this invention is to provide a fluid pump, the housing of which is free of threads, crimps and other mechanical fastener devices.

Another object of this invention is to provide a fluid pump having a housing which is highly dent-resistant.

Another object of this invention is to provide a fluid pump in which stage-to-stage compression forces are substantially maintained over the life of the pump.

Yet another object of this invention is to provide a fluid pump, the housing of which exerts rotation-resisting countertorque on certain pump members.

Another object is to provide a pump which is more cost-effective to make.

How these and other important objects are accomplished will be apparent from the following descriptions and from the drawing.

SUMMARY OF THE INVENTION

The present invention overcomes the disadvantages of the prior known pump constructions by providing a one-piece composite pump housing which virtually eliminates fluid leakage and thus enhances pump performance.

The pump assembly includes a one-piece composite housing bonded to an adapter, an output flange and one or more pump members to form a thread-free, unitary pump. Each pump member consists of a diffuser and suction cap which cooperate to house an impeller. Two or more pump members may be arranged to abut one another in "stacked" relationship to increase pump output. In such arrangement, the pump impellers are rotated by a common shaft.

The filamentous portion of the composite housing is wound about the pump members and overlaps the adapter and output flange. The resinous component of the composite housing bonds with the surface of the adapter and output flange to form adapter and output flange joints. The resin also bonds with surface areas of the diffuser and suction cap and flows into the openings between the pump members.

Once hardened, the composite housing forms a high-surface-strength material providing compressive force which holds the adapter, output flange and pump members in a fixed relationship one to the other. The composite housing also covers and seals the openings between (a) the pump members and the housing and (b) the openings between the pump members themselves, all to prevent fluid leakage and enhance performance of the pump. Moreover, the bonds formed by the composite housing prevent rotation of the pump members in response to torque forces.

Other objects, features, and advantages of the invention will be apparent from the following detailed description taken in connection with the accompanying drawing.

BRIEF DESCRIPTION OF THE DRAWINGS

The present invention will be more fully understood by reference to the following detailed description of a preferred embodiment of the present invention when read in conjunction with the accompanying drawing, in which like reference characters refer to like parts throughout the views and in which.

DETAILED DESCRIPTION OF THE PREFERRED EMBODIMENTS

Figure 1:
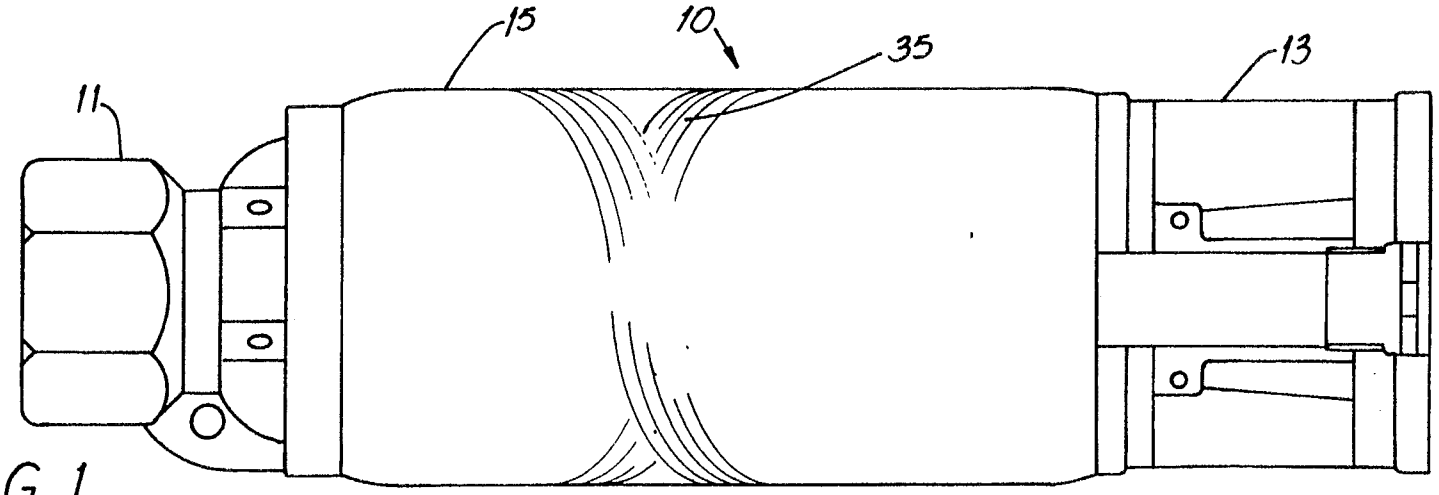
FIG. 1 is a side perspective view of the exterior of a pump embodying the present invention.
Figure 2:
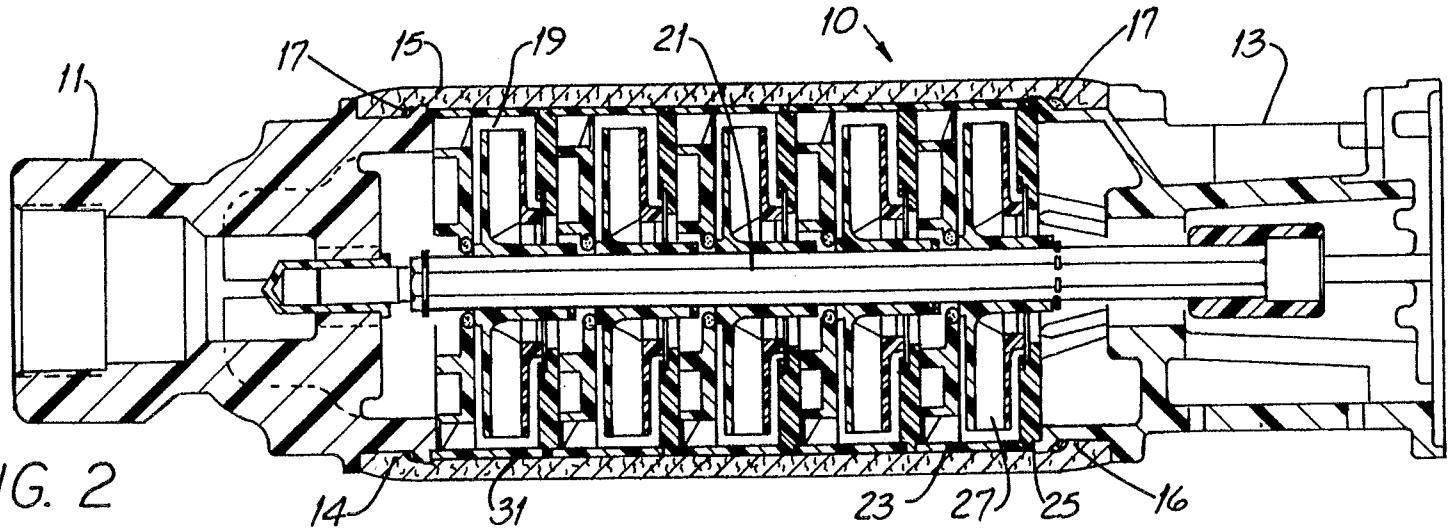
FIG. 2 is a longitudinal cross-section view of a pump embodying the present invention.

Referring first to FIGS. 1 and 2, there is shown a fluid pump 10 embodying the present invention. Pump 10 has an output flange 11 at one end, an adapter 13 at the other end and a housing 15 disposed between output flange 11 and adapter 13. One or more pumping members 19 are disposed within housing 15 and between output flange 11 and adapter 13.

Figure 7:
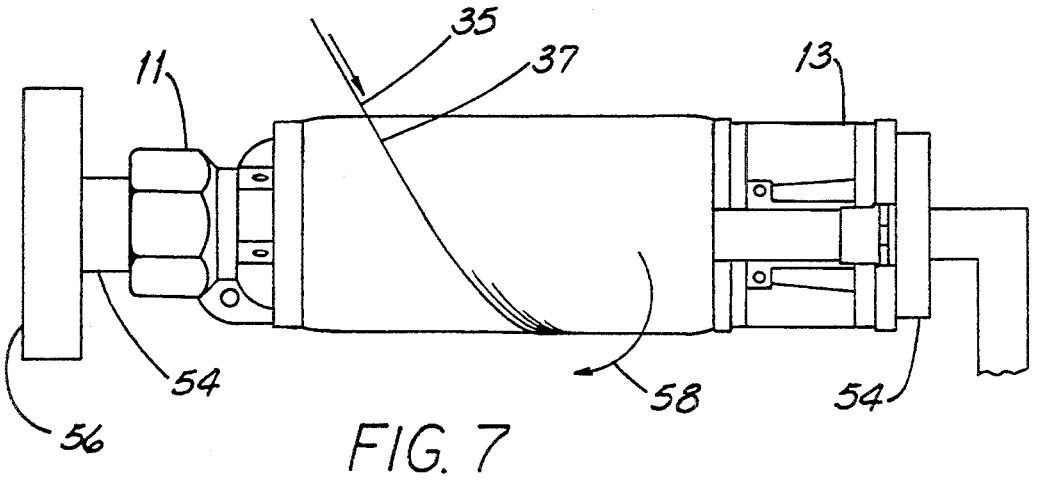
FIG. 7 is a perspective view depicting a pump housing being formed pursuant to one method of the invention.
Figure 5:
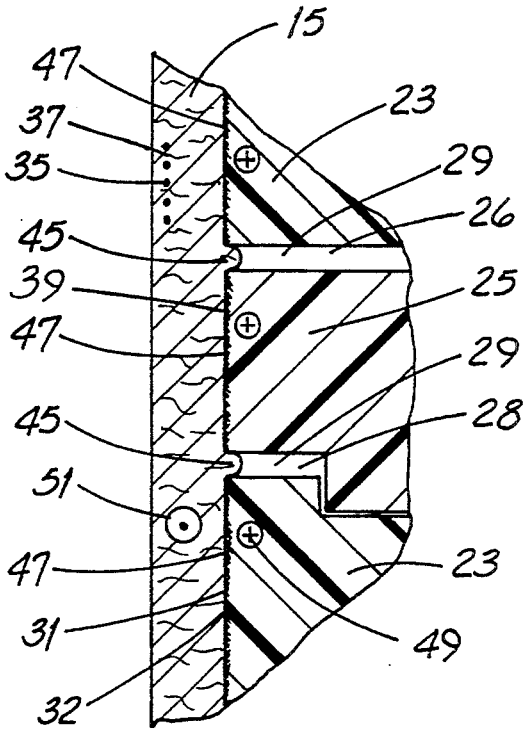
FIG. 5 is an enlarged cross-section view of a portion of a pump member and housing. Parts are broken away.

Output flange 11 and adapter 13 are preferably molded from a plastic material in order to reduce manufacturing cost while also reducing the overall weight of pump 10. As shown in FIGS. 5 and 7, housing 15 is preferably a composite material comprising a plurality of fiberglass strands 35 coated with an epoxy resin 37. The composite non-metallic structure gives housing 15 a high surface strength. Resin-coated strands 35 are wound about output flange 11, pumping members 19 and adapter 13. Once hardened, housing 15, pumping members 19, output flange 11 and adapter 13 are permanently bonded together to form a unitary structure. As a consequence of this novel structure, housing 15 is thread-free and is in thread-free engagement with both the output flange 11 and adapter 13.

Figure 3:
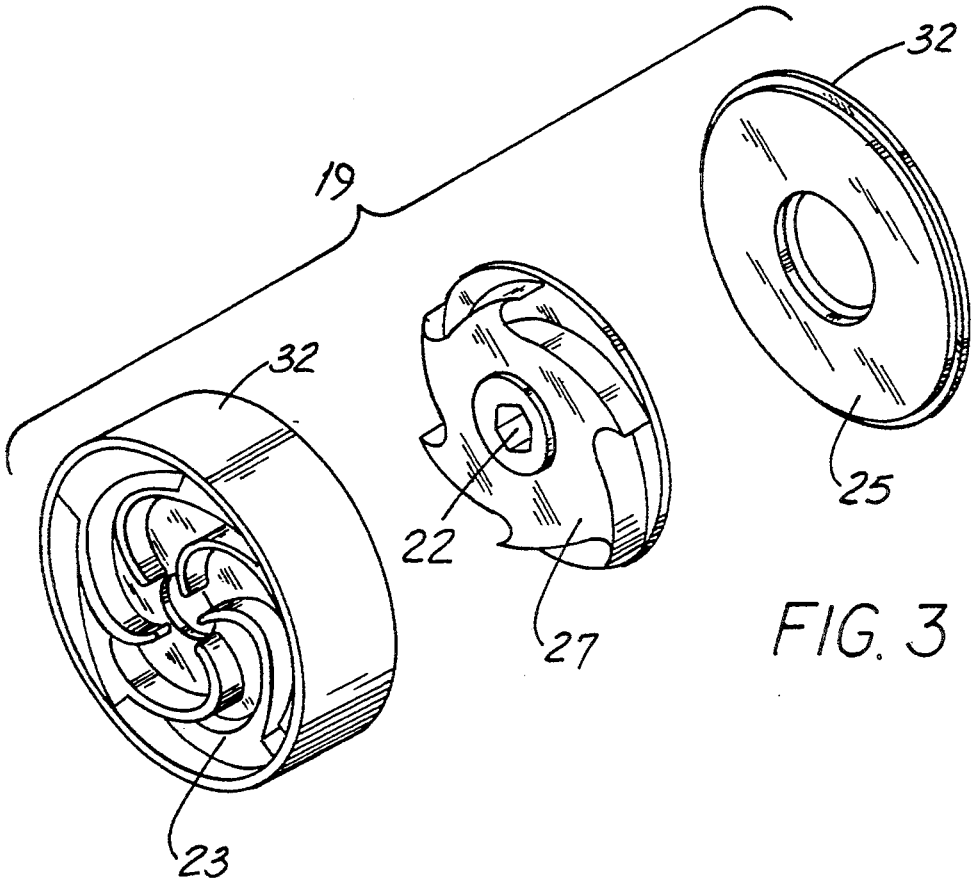
FIG. 3 is an exploded view of a pump member comprised of a suction cap, a diffuser and an impeller.
Figure 4:
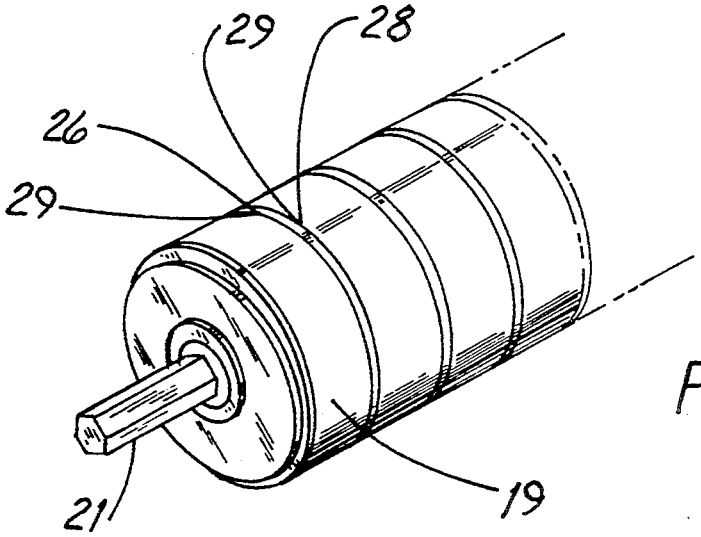
FIG. 4 is a perspective view of a plurality of pump members and a drive shaft inserted in the keyhub of each impeller.

FIGS. 2, 3 and 4 depict one embodiment of the invention which includes a plurality of pumping members 19 within housing 15. Pumping members 19 are stacked in contiguous relation one to another concentric with impeller shaft 21. Each pumping member 19 includes a diffuser 23 and a suction cap 25. A centrifugal impeller disk 27 is confined within the diffuser 23 and suction cap 25. Impeller shaft 21 is inserted in keyhub 22 of each impeller 27 and thereby drives such impellers 27.

FIGS. 4 and 5 show an opening, or interstice 29, at the junction 26 of each diffuser 23 and suction cap 25 and at the junction 28 of abutting pumping members 19. Pumping members 19 are preferably formed of plastic materials having nonfusing properties in order to reduce the weight of pump 10 and avoid rust and corrosion of pumping members 19. Each diffuser 23 and suction cap 25 forming a pumping member 19 has a surface area 32 facing the interior wall 31 of housing 15.

As shown in FIGS. 1, 2, 3 and 5, strands 35 forming housing 15 are coated with liquid resin 37. Resin-coated strands 35 forming housing 15 overlap output flange 11 to form flange joint 14 and overlap adapter 13 to form adapter joint 16. Resin 37 coating strands 35 flows into pores 39 on the outwardly-facing surface areas 32 of diffuser 23 and suction cap 25, i.e., the areas 32 facing interior wall 31 of housing 15. Resin 37 also flows into interstice 29 at junction 26 between diffuser 23 and suction cap 25 as well as into interstice 29 at junction 28 between abutting pumping members 19.

Once hardened, resin 37 forms a bond between housing 15 and pumping members 19 and between adjacent pumping members 19. Such hardened, bonded resin 37 forms a fluid-tight seal 45 in interstice 29 between diffuser 23 and suction cap 25 and in interstice 29 between abutting pump members 19. And because of such hardened resin 37, housing 15 is bonded to substantially the entirety of the outer surface areas 32 of diffuser 23 and suction cap 25 forming a pumping member 19 and thereby forms a fluid-tight seal 47 between pumping members 19 and housing 15. Gaskets 17 may be positioned about output flange 11 and adapter 13 to provide additional seals between housing 15 and the pump components.

The following portion of the specification refers to "torque," a unit of measure from the field of engineering mechanics. As is commonly understood, torque is a force acting through a lever arm. Such specification also refers to "shear," a term from the field of mechanics of materials. When material is in shear, portions thereof are urged by external forces to move linearly in opposite directions.

Referring further to FIG. 5, in operation, fluid being pumped, e.g., water, exerts torque on the diffuser 23 and suction cap 25 thereby tending to rotate those parts about the shaft 21. Such torque is represented by symbol 49 which is a force in a direction into the drawing sheet and acting along a radius measured from the centerline of shaft 21.

However, because housing 15 and pumping members 19 are bonded together, housing 15 is in torsion and exerts countertorque (represented by the symbol 51) on the diffuser 23 and suction cap 25 and prevents rotation thereof. And each bonded joint, e.g., housing/pumping member joint 47, flange joint 14 or adapter joint 16, is in shear.

Figure 6:
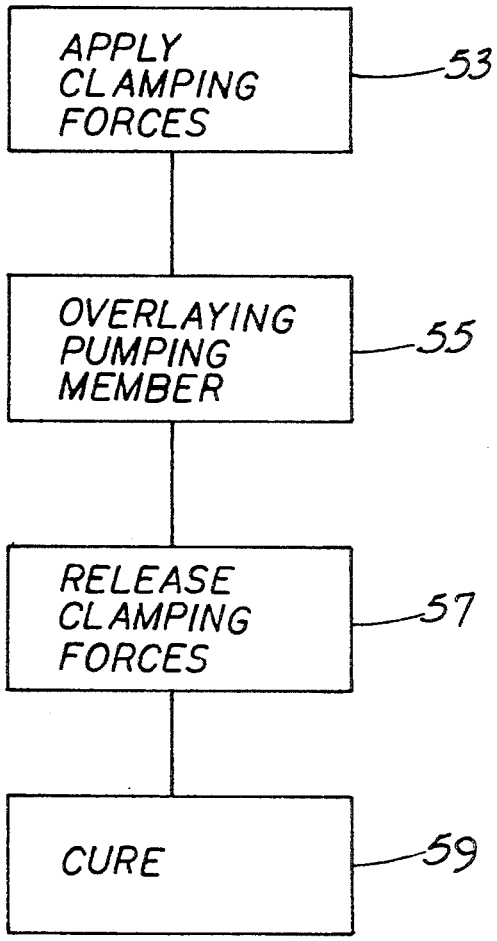
FIG. 6 is a flow-diagram depicting one method of making the invention.

Referring next to FIGS. 6 and 7, a method for making the new pump 10 will now be described. According to the method, longitudinally opposed clamping forces (represented by symbol 53) are applied to an output flange 11, at least one pumping member 19 and an adapter 13 holding such components in contiguous relationship one to the other. For example, the clamping forces may be applied by end caps 54 of a device for rotating objects 56.

In the second step, the output flange 11, at least one pumping member 19 and adapter 13 are overlayed (as represented by symbol 55) with a substance that forms a permanent bond with such components holding them in fixed relationship one to the other. In a preferred method, the substance overlayed is a plurality of resin-coated fiberglass strands 35 which are wound about output flange 11, the at least one pumping member 19 and adapter 13 as such components are rotated (as represented by the symbol 58) in device 56. Flange joint 14 and adapter joint 16 are formed where strands 35 overlap output flange 11 and adapter 13 respectively.

In the third step (and as represented by symbol 57), the clamping forces are released. After the clamping forces are released, output flange 11, the at least one pumping member 19 and adapter 13 are held in contiguous relationship through force applied by the resin-coated fiberglass strands 35 wound about such components and further secured at flange joint 14 and adapter joint 16.

In the final step of the method (as represented by symbol 59), resin 37 is cured so that fiberglass strands 35 are permanently bonded to output flange 11, the at least one pumping member 19 and adapter 13. Depending upon the properties of resin 37 used, curing may be performed at room temperature (approximately 25° C.) or, to accelerate curing, at higher temperatures.

While the principles of this invention have been described in connection with specific embodiments, it should be understood clearly that these descriptions are made only by way of example and are not intended to limit the scope of the invention.

What is claimed:

1. In a fluid pumping apparatus having a plurality of pumping members and a composite housing around the pumping members, the improvement wherein:

the apparatus has a plurality of interstices between the pumping members;

the housing is bonded to the pumping members and forms a fluid tight seal between the pumping members and the housing; and the housinq seals the interstices to form a fluid-tight seal between the pumping members.

2. The invention of claim 1 wherein:

the pumping apparatus has a first end attached to an output flange and a second end attached to an adapter; and the housing is bonded to the output flange and adapter whereby the pumping member, output flange and adapter are maintained in fixed relationship one to the other.

3. The invention of claim 2 wherein the housing is thread-free.

4. The invention of claim 2 wherein the housing is in thread-free engagement with the adapter.

5. The invention of claim 2 wherein the housing is in thread-free engagement with the output flange.

6. The invention of claim 1 wherein:

the housing is made of a high surface strength, non-metallic material.

7. The invention of claim 1 wherein the housing is in torsion preventing rotation of the pumping member(s).

8. The invention of claim 1 wherein there is a bond joint at the juncture of the housing and a pumping member and the bond joint is in shear.

9. The invention of claim 1 further comprising:

a plurality of fiberglass strands paid through an epoxy resin and wrapped around the pumping members to form a unitary housing once hardened, the resin forming a continuous bond between the pumping members and the housing and between the pumping stages and forms a fluid-tight seal between the pumping members and between the pumping members and housing.

10. An elongate, generally cylindrical, multiple-stage water well pump including plural pumping members in stacked relationship one to another and wherein (a) the pump has a drive shaft, (b) each pumping member is driven by the drive shaft and pumps substantially clear water contained in the pump, (c) each pumping member has a diffuser tending to rotate with the drive shaft during liquid pumping, the pump further including:

a rigid, composite housing made of resin and fibrous strands and is permanently bonded to the diffusers; and wherein:

the housing is on the exterior of the pump;

the housing contacts each diffuser at a bond joint and is bonded to each diffuser at the bond joint;

the housing is spaced from and out of contact with the water contained in the pump;

the housing forms a fluid tight seal at the bond joint;

the bond joint is in shear and prevents rotation of the diffusers; and the housing extends entirely around each diffuser.

* * * * *